US012768261B2

(12) United States Patent
Sun et al.

(10) Patent No.: US 12,768,261 B2
(45) Date of Patent: Oct. 20, 2026

(54) CONTROLLING PROCESS VARIABLES IN CONCURRENT WELLBORE OPERATIONS

(71) Applicant: Halliburton Energy Services, Inc., Houston, TX (US)

(72) Inventors: Zhijie Sun, Spring, TX (US); Elijah Bogle, Fort Worth, TX (US); Michael Pierce, Cypress, TX (US); Eric Elliott, Lovington, NM (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/174,080

(22) Filed: Apr. 9, 2025

(65) Prior Publication Data

US 2026/0318180 A1 Oct. 15, 2026

(51) Int. Cl.
*E21B 44/00* (2006.01)
*E21B 43/267* (2006.01)

(52) U.S. Cl.
CPC ..... *E21B 44/00* (2013.01); *E21B 43/267* (2013.01)

(58) Field of Classification Search
CPC ..... E21B 44/00; E21B 49/003
See application file for complete search history.

(56) References Cited

U.S. PATENT DOCUMENTS

| | | | | |
|---|---|---|---|---|
| 10,794,162 | B2 * | 10/2020 | Stolboushkin | E21B 43/2408 |
| 11,215,051 | B2 * | 1/2022 | Chang | E21B 47/135 |
| 11,226,137 | B2 * | 1/2022 | O'Malley | E21B 47/10 |
| 2014/0216732 | A1 * | 8/2014 | Stone | E21B 43/2406 166/250.15 |
| 2014/0352968 | A1 | 12/2014 | Pitcher et al. | |
| 2023/0243351 | A1 | 8/2023 | Grimes et al. | |

* cited by examiner

*Primary Examiner* — Catherine Loikith
(74) *Attorney, Agent, or Firm* — Kilpatrick Townsend & Stockton LLP

(57) ABSTRACT

A computing system can be used to control concurrent wellbore operations. For example, the computing system can receive a process variable value of a process variable for two or more wellbore operations. The process variable may be a parameter of each of the two or more wellbore operations that is dependent on a manipulated variable of each of the two or more wellbore operations. The computing system may further receive a constraint. The constraint may include a maximum process variable value. The computing system may then determine, based on the constraint and the process variable value for each of the two or more wellbore operations, a manipulated variable value of the manipulated variable for each of the two or more wellbore operations. Additionally, the computing system can control the two or more wellbore operations using the manipulated variable value for each of the two or more wellbore operations.

17 Claims, 7 Drawing Sheets

CONTROLLING PROCESS VARIABLES IN CONCURRENT WELLBORE OPERATIONS

TECHNICAL FIELD

The present disclosure relates generally to wellbore operations and, more particularly (although not necessarily exclusively), to controlling process variables for two or more wellbores in concurrent wellbore operations performed with respect to the two or more wellbores.

BACKGROUND

Wellbore operations may include various equipment, components, methods, or techniques to form a wellbore and to displace and release produced material from the wellbore. The produced material may include hydrocarbons, water, and the like. The wellbore can be formed or otherwise positioned in a subterranean formation or other suitable geological formation that may include hydrogen deposits or other deposits that have a potential for forming hydrogen. Recovering hydrogen from the formation via the wellbore may be technically challenging.

DETAILED DESCRIPTION

Figure 1:
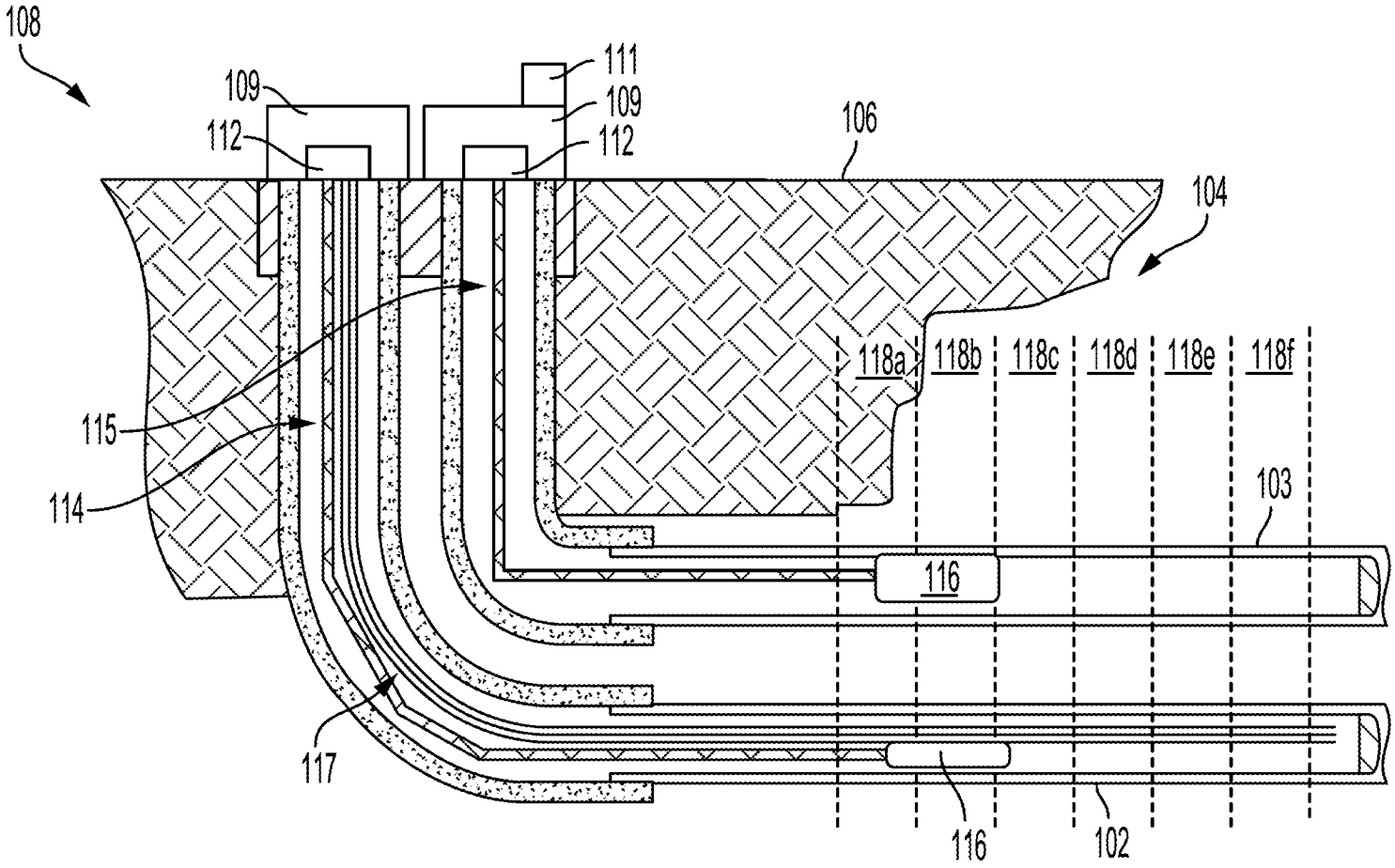
FIG. 1 illustrates an example of a well system in which concurrent wellbore operations may be performed, according to some embodiments of the present disclosure.

Certain aspects and examples of the present disclosure relate to a controller for controlling process variables in concurrent wellbore operations performed with respect to two or more wellbores. A wellbore may be formed or otherwise positioned in a geological formation, which may be or include a subterranean formation, a suboceanic formation, or any other suitable geological formation that may include hydrogen or hydrogen-producing components. The concurrent wellbore operations may involve performance of a wellbore operation (e.g., a drilling operation, a completion operation, a production operation, or the like) at more than one wellbore substantially simultaneously. For example, a fracturing operation can be performed at more than one wellbore substantially simultaneously to enhance operational efficiency and wellbore production. To control process variables in concurrent wellbore operations, the controller may determine a value for a manipulated variable for each wellbore associated with the concurrent wellbore operations. The controller may further control equipment associated with each wellbore using the value of the manipulated variable. The manipulated variable may be any parameter (e.g., a physical property) of the wellbore operation that can be controlled from a surface of the wellbore, while the process variable can be any parameter (e.g., a performance metric or physical property) of the wellbore that is at least partially dependent on the manipulated variable. Accordingly, by controlling the equipment using the value of the manipulated variable, the controller can affect a process variable in a desired manner and can do so for more than one wellbore substantially simultaneously. The controller can therefore provide an overarching and efficient solution to controlling concurrent wellbore operations (e.g., a simultaneous fracturing operation).

In some examples, given a process variable and a manipulated variable, a controller (e.g., a closed-loop feedback controller) is designed to continuously adjust the manipulated variable such that the process variable tracks a reference vector. The controller can further be designed such that the manipulated variable is adjusted by the controller at more than one wellbore concurrently. As such, the process variable at each wellbore can track the reference vector. The manipulated variable may be any independent variable of a wellbore operation. In other words, the manipulated variable may be any physical property of the wellbore operations that can be controlled from a surface of the wellbore. Examples of manipulated variables include slurry rate, proppant concentration, and liquid additive concentration. In contrast, a process variable may be any dependent variable of the wellbore operation. Thus, a process variable may depend at least in part on an instantaneous value or a trajectory of one or more manipulated variables. Examples of process variables include surface treating pressure, wellhead pressure, bottom hole treating pressure, hydraulic horsepower used, electrical power used by one or more electric pumps, slurry density, and slurry viscosity.

Additionally, the reference vector can include a setpoint of a process variable for each wellbore involved in concurrent wellbore operations. For example, the reference vector may be denoted as $r=[r_1, r_2, \ldots, r_N]$ where N is the number of wellbores and $r_N$ denotes the setpoint for the process variable of the N-th well. The setpoint may be a maximum value of the process variable for each wellbore. Accordingly, it may be desirable to keep the process variable of each wellbore at or below the corresponding setpoint. The process variable may be kept at or below the corresponding setpoint via the continuous adjustment to the manipulated variable during the concurrent wellbore operations.

In some examples, the controller may receive one input (e.g., a value of a process variable) and provide one output (e.g., a value of a manipulated variable) per wellbore. In other examples, the controller may receive multiple inputs (e.g., values of two or more process variables), provide multiple outputs (e.g., values of two or more manipulated variables), or a combination thereof per wellbore.

Moreover, in some examples, the controller may be a model-predictive controller. In such examples, the controller may use a model of the concurrent wellbore operations to predict outcomes of the concurrent wellbore operations, values of the process variables, or the like. The model may include each of the wellbores included in the concurrent wellbore operations and devices associated with each of the wellbores. The predictions of the outcomes, of the values of process variables, or the like may then be used to determine values of manipulated variables and control the concurrent wellbore operations.

In some examples, the controller can be provided via a centralized control system. The centralized control system may include a single server or other computing device on which the controller may be implemented. As a result, the server or other computing device may determine values of manipulated variables for two or more wellbores and may control device(s) (e.g., a pump group) at each of the wellbores to implement the manipulated variables, thereby affecting process variables at the wellbores.

Alternatively, in some examples, the controller can be provided via a distributed control system. The distributed control system may include more than one server or other computing device on which the controller may be implemented in a distributed manner. For example, the controller may include a set of sub-controllers that each run on a server or other computing device and that are each associated with a wellbore. In another example, some of the sub-controllers may be on the same server. For example, for a quad-fracturing operation where four wellbores are treated substantially simultaneously, a first sub-controller and a second sub-controller may be on one server while a third sub-controller and a fourth sub-controller may be on another server.

In addition to the sub-controllers, the controller may include a selector. The selector may execute on the same server or other computing device as one or more of the sub-controllers or may execute on a separate server or other computing device. The selector may communicate with the sub-controllers to facilitate selection of values for manipulated variables. For example, the selector may receive interim values for manipulated variables from each of the sub-controllers. The selector may then choose final values for the manipulated variables based on the interim values and send the final values back to each server executing each sub-controller. The sub-controllers can then cause corresponding wellbore device(s) (e.g., a pump group) at each wellbore to implement the final value of the manipulated variable. In this way, the sub-controllers can control a process variable dependent on the manipulated variable.

Moreover, in the distributed control system, if there is a loss of communication (e.g., a loss of communication between a sub-controller and the selector or between a sub-controller and a device at a wellbore), the sub-controllers may stop calculation. That is, the sub-controllers may stop calculation of values for the manipulated variables. If calculations stop, each sub-controller may keep the manipulated variable for each wellbore at a previously determined value. Additionally, if calculations stop, a warning message (e.g., "Lost connection to Well 3 Server") may be shown on one or more displays associated with the servers or other devices executing the sub-controllers. Furthermore, in the distributed control system, there may be one or more buttons on the displays associated with each sub-controller. The buttons may allow each sub-controller on that server to be disabled or enabled. The selector may only select values for the manipulated variables when the sub-controllers are enabled. If a sub-controller is disabled, the server may send a message to other servers to disable the sub-controllers on the other servers.

In one particular example, a manipulated variable for a set of wellbores at which concurrent fracturing operations are performed is a slurry rate. The slurry rate may be a measurement of a volume of a fluid mixture (referred to herein as a slurry) pumped into a wellbore per unit of time. The slurry rate for the set of wellbores can be represented as $u=[u_1, \ldots, u_N]$, where N is the number of wellbores in the set of wellbores. Additionally, in the particular example, a process variable for the set of wellbores is a treating pressure. The treating pressure may be a measurement of pressure applied at the wellhead during a wellbore operation in which fluids are pumped into a subterranean formation to increase production by creating fractures or dissolving mineral deposits (e.g., a fracturing operation). The treating pressure for the set of wellbores can be represented as $y=[y_1, \ldots, y_N]$, where N is the number of wellbores in the set of wellbores.

In the particular example, a constraint on the manipulated variable may indicate that the slurry rate of all of the wellbores is to be substantially equivalent (Equation 1).

$$u_1 = u_2 = \ldots = u_N \quad \text{(Equation 1)}$$

Another constraint on the manipulated variable may indicate that the slurry rate should be equal to or less than a maximum slurry rate. Equation 2 shows this constraint. $u_{max}$ is the maximum slurry rate in equation 2.

$$u_1 = u_2 = \ldots = u_N \leq u_{max} \quad \text{(Equation 2)}$$

In the particular example, there may also be constraints imposed on the process variable. For example, a constraint on the treating pressure may indicate that the treating pressure of each well is to be equal or less than a setpoint $$(y_n^*).$$

An example of such a constraint on the treating pressure is shown in equation 3.

$$y_n \leq y_n^* \quad \text{(Equation 3)}$$

Additionally, in the particular example, a controller includes of a set of parallel sub-controllers (e.g., proportional-integral (PI) controllers). The n-th sub-controller may take the treating pressure from the n-th wellbore (n) as feedback and produce an interim slurry rate ($u_n$). The outputs of all the sub-controllers (e.g., the interim slurry rates) can then be input into a selector of the controller. The selector of the controller may select a lowest interim slurry rate setpoint as the slurry rate for the wellbores (Equation 4). The sub-controllers may then adjust slurry rates as implemented by pump groups at each of the wellbores based on the selected slurry rate. Such adjustments can keep the treating pressure at each of the wellbores at or below the setpoint.

$$u_1 = u_2 = \ldots = u_N = \min(\hat{u}_1, \hat{u}_2, \ldots, \hat{u}_N) \quad \text{(Equation 4)}$$

There may be other constraints imposed on the manipulated variable, the process variable, or the combination thereof in other examples. For example, a constraint on the manipulated variable may indicate that values one or more of the manipulated variables should be less than or equal to the values of other manipulated variables. An example of such a constraint is shown in Equation 5.

$$u_1 \leq u_2 \leq \ldots \leq u_N \quad \text{(Equation 5)}$$

To facilitate generation of values of the manipulated variable that meet the constraint shown in equation 5, a selector may limit the interim values of manipulated variables generated by sub-controllers. For example, if the interim values of the manipulated variable received by the selector do not meet the constraint (e.g., if $\hat{u}_2 > u_3$), the selector can modify the interim values to provide final values for the manipulated variables that meet the constraint. In the example of $\hat{u}_2 > \hat{u}_3$, selector may modify $\hat{u}_2$ such that the final value is equal to $\hat{u}_3$ (i. e., such that $u_2 = \hat{u}_3$). In another example, a constraint on the manipulated variable may be a limit to a rate of change of the manipulated variable. That is, for example, $d\hat{u}_i/dt$ may not exceed certain value.

Additionally, logic of the selector can take other forms in other examples. For example, rather than selecting a minimum value, the selector may choose the i-th interim value of the manipulated variable received. The i-th interim value may be the i-th interim value that produces the least rate of change of the value of the manipulated variable for each of the wells (Equation 6)

$$\text{argmin}(d\hat{u}_1/dt, \ldots, d\hat{u}_N/dt) \quad \text{(Equation 6)}$$

This implementation can ensure that a conservative value for the manipulated variable is selected in terms of the rate of change, which can prevent damage to wellbore devices.

In some examples, the selector may apply a dwell time to the selection. For example, after selecting a value for the manipulated variable, for a subsequent period of dwell time (e.g., a subsequent 10 seconds, 30 seconds, or 60 seconds) the value is continuously selected. This can prevent frequent changes to the process variable, thereby preventing instability within a given system.

Moreover, for a set of wellbores, a process variable of interest to the controller for at least some of the wellbores may be different. For example, the process variable for a first wellbore in the set of wellbores may be a surface treating pressure, while the process variable for a second wellbore in the set of wellbores may be power consumption by one or more electric pumps. In this case, each process variable may be converted to a unitless number. Equation 7 is an example of an equation for converting the process variables for each wellbore to a unitless number.

$$\frac{y_n - y_{n,min}}{y_{n,max} - y_{n,min}} \quad \text{(Equation 7)}$$

In Equation 7, $y_{i,min}$ and $y_{i,max}$ are minimum and maximum possible values of the i-th process variable. The controller may select a manipulated variable for each wellbore based on the unitless number for each process variable for each wellbore.

Additionally or alternatively, for the set of wellbores, a manipulated variable controlled by the controller for at least some of the wellbores may be different. For example, the manipulated variable for a first wellbore in the set of wellbores may be a slurry rate, while the manipulated variable for a second wellbore in the set of wellbores may be proppant concentration. In this case, each manipulated variable may similarly be converted to a unitless number.

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 illustrates an example of a well system 108 in which concurrent wellbore operations may be performed, according to some embodiments of the present disclosure. As shown in the example of FIG. 1, the well system 108 includes a first wellbore 102 and a second wellbore 103 in a subsurface formation 104 beneath a surface 106. The first wellbore 102 and the second wellbore 103, as shown in the example of FIG. 1, include horizontal wellbores. However, it may be appreciated that embodiments are not limited thereto and that the well system 108 may include any combination of horizontal, vertical, slant, curved, and/or other wellbore orientations.

The subsurface formation 104 may include a reservoir that contains hydrocarbon resources, such as oil, natural gas, and/or others. For example, the subsurface formation 104 may be a rock formation (e.g., shale, coal, sandstone, granite, and/or others) that includes hydrocarbon deposits, such as oil and natural gas. In some cases, the subsurface formation 104 may be a tight gas formation that includes low permeability rock (e.g., shale, coal, and/or others). The subsurface formation 104 may be composed of naturally fractured rock and/or natural rock formations that are not fractured to any significant degree.

In the example shown, the well system 108 also includes well pads 109 and fluid injection systems 112 associated with each of the wellbores 102, 103. The fluid injection systems 112 can be for injecting treatment fluid, e.g., hydraulic fracturing fluid, into the subsurface formation 104 over multiple sections 118*a*, 118*b*, 118*c*, 118*d*, 118*e* and 118*f* (collectively referred to herein as "sections 118") of each of the wellbores 102 and 103. Each of the sections 118 may correspond to, for example, a different stage or interval of the concurrent wellbore operation, which is this example is a multi-well stimulation treatment. Although six sections are shown in FIG. 1, it should be appreciated that any number of sections and/or treatment stages may be used. Furthermore, each of the sections 118 may have different widths or may be uniformly distributed along wellbores 102 and 103.

As shown in FIG. 1, well system 108 includes a controller 111, a signaling subsystem 114 installed in the first wellbore 102 and a signaling subsystem 115 installed in the second wellbore 103, and one or more downhole devices 116 installed in wellbores 102 and 103. The controller 111 can communicate with the fluid injection systems 112, the downhole devices 116, or the combination thereof from a surface 110. Although not shown in FIG. 1, well system 108 may include additional and/or different features for implementing the process variable monitoring and control techniques disclosed herein. For example, the well system 108 may include any number of computing subsystems, communication subsystems, pumping subsystems, monitoring subsystems, blenders, manifolds, pressure and rate monitoring subsystems, and/or other features as desired for different implementations.

In certain illustrative embodiments, the sensors 117 (e.g., fiber-optic sensors) may be used to obtain real-time measurements and diagnostic data of both the first and/or second wellbores and/or additional production or monitoring wellbores during the multi-well multistage stimulation treatment. Real-time measurement data may be, for example optical intensity measurements, optical wavelength measurements, optical frequency or phase measurements where the optical measurements can be used to derive temperature, pressure, acoustic, strain, micro-seismic, micro-deformation, or other formation related properties. Diagnostic data may be, for example, temperature vs. depth profiles, strain vs. depth profiles, acoustic intensity and/or frequency depth profiles, micro-seismic vs. 3D space in the vicinity of a treatment or monitoring wellbore, micro-deformation vs. 3D space in the vicinity of a treatment or monitoring wellbore, surface and/or subsurface pressure and this data can be used to monitor down-hole changes over time and space as the fracking operations progress.

Thus, in the example shown, downhole data collected by the sensors 117 may be transmitted to the controller 111. The downhole data the controller 111 receives may then be used to perform real-time monitoring and control of the wellbores 102 and 103, as described in further detail below with respect to FIGS. 2-7.

In some implementations, the controller 111 may be communicatively coupled to the sensors 117. In some implementations, the sensors 117 may be communicatively coupled to a separate (e.g., remote) controller. In some implementations, the controller 111 may be communicatively coupled to a remote computing system for exchanging information via a network for purposes of monitoring and controlling wellsite operations, including operations related to the stimulation treatment. Such a network may be, for example and without limitation, a local area network, medium area network, and/or a wide area network, e.g., the Internet.

Pressure can also be measured at the surface 106 and/or in the subsurface formation 104. The measured pressure may change as fractures open, as pump flow rates change, as formation properties change, as chemical additives change, or a combination thereof as a result of multi-well fracturing operations (e.g., the multi-well stimulation treatment). The measured pressure can further be correlated with various distributed measurements and manipulated variables of the fracturing operations (e.g., slurry rates). Corrective actions may be taken by the controller 111 if the pressure deviates from expected results.

For example, during each stage of the multi-well stimulation treatment, the well system 108 may alter stresses and create a multitude of fractures in the subsurface formation 104 by injecting the treatment fluid into the surrounding subsurface formation 104 via a plurality of formation entry points along a portion of wellbores 102 and 103 (e.g., along one or more of sections 118). The treatment fluid may be injected through any combination of one or more valves of the downhole devices 116. The downhole devices 116 may include numerous components including, but not limited to, valves, sliding sleeves, actuators, ports, and/or other features that communicate treatment fluid from working strings disposed within wellbores 102 and 103 into the subsurface formation 104 via the formation entry points. The formation entry points may include, for example, open-hole sections along an uncased portion of the wellbore path, a cluster of perforations along a cased portion of the wellbore path, ports of a sliding sleeve completion device along the wellbore path, slots of a perforated liner along the wellbore path, or any combination of the foregoing.

Moreover, the treatment fluid may be injected through the fluid injection systems 112, which may include or fluidly communicate with some of the downhole devices 116. For example, the fluid injection system 112 of each of the wellbores 102, 103 may include the working strings, one or more pumps to deliver the treatment fluid (e.g., a surface pump to pump the treatment fluid from storage tanks to a wellhead of each of the wellbores 102, 103), injection lines (e.g., pipes) to direct the treatment fluid downhole, specialized equipment like packers or control valves to control injection of the treatment fluid into the subterranean formation 104, or the like.

The operation of the fluid injection systems 112, the downhole devices 116, or the combination thereof may be controlled by the controller 111. The controller 111 may include, for example, data processing equipment, communication equipment, and/or other systems that control injection treatments applied to the subsurface formation 104 through wellbores 102 and 103. In one or more embodiments, the controller 111 may receive, generate, or modify manipulated values (e.g., slurry rates implemented via pumps of the fluid injection systems 112) for implementing the various stages of the stimulation treatment along the path of wellbores 102 and 103.

In one or more embodiments, the controller 111 initiates control signals to configure the fluid injection systems 112, downhole devices 116, other equipment (e.g., pump trucks, etc.), or combination thereof for operation. To control the fluid injection systems 112, the controller 111 may adjust manipulated variables such as injection or slurry rate, proppant concentration, additive ratios, and the like. The controller 111 may adjust such manipulated variables by adjusting parameters of pumps, adjusting a composition of the fluid, introducing specialized diverting agents, executing real-time monitoring systems, optimizing pumping schedules, or the like and may do so based on data received from the sensors 117, the downhole devices 116, or the combination thereof. The data may be indicative of formation characteristics, desired fracture geometry, or process variables (e.g., wellhead pressure).

In some examples, the signaling subsystems 114 and 115 as shown in FIG. 1 transmit the signals from the controller 111 at the surface 106 to one or more of the downhole devices 116 disposed in wellbores 102 and 103. For example, signaling subsystems 114 and 115 may transmit hydraulic control signals, electrical control signals, and/or other types of control signals. The control signals may be reformatted, reconfigured, stored, converted, retransmitted, and/or otherwise modified as needed or desired enroute between the controller 111 (and/or another source) and the downhole devices 116 (and/or another destination). The signals transmitted to the downhole devices 116 may control the configuration and/or operation of the downhole devices 116.

Examples of different ways to control the operation of each of the downhole devices 116 include, but are not limited to, opening, closing, restricting, dilating, repositioning, reorienting, and/or otherwise manipulating one or more valves of the tool to modify the manner in which treatment fluid, proppant, or diverter is communicated into the subsurface formation 104. It should be appreciated that the combination of injection valves of the downhole devices 116 may be configured or reconfigured at any given time during the multi-well stimulation treatment.

Moreover, it should also be appreciated that the fluid injection systems 112 and/or injection valves may be used to inject any of various treatment fluids, proppants, and/or diverter materials into the subsurface formation 104. Examples of such proppants include, but are not limited to, sand, bauxite, ceramic materials, glass materials, polymer materials, polytetrafluoroethylene materials, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, lightweight particulates, microsphere plastic beads, ceramic microspheres, glass microspheres, manmade fibers, cement, fly ash, carbon black powder, and combinations thereof.

In one or more embodiments, the downhole devices 116 may additionally or alternatively include one or more sensors for collecting data relating to downhole operating conditions and formation characteristics along the wellbores 102 and 103. Such sensors may serve as real-time data sources for various types of downhole measurements and diagnostic information pertaining to each stage of the multi-well stimulation treatment. Examples of such sensors include, but are not limited to, DTS, DAS, DSS, microseismic sensors, tiltmeters, pressure sensors, and other types of downhole sensing equipment. The data collected downhole by such sensors may include, for example, real-time measurements and diagnostic data for monitoring the extent of fracture growth and complexity within the surrounding formation along wellbores 102 and 103 during each stage of the multi-well stimulation treatment, e.g., corresponding to one or more sections 118. In some implementations, the downhole devices 116 may include fiber-optic sensors for collecting real-time measurements of acoustic intensity and/or frequency and/or acoustic phase information or thermal energy downhole during the multi-well stimulation treatment.

In one or more embodiments, the signaling subsystems 114 and 115 may be used to transmit real-time measurements and diagnostic data collected downhole by one or more of the aforementioned data sources to the controller 111 for processing at the surface 106. The controller 111 (or data processing components thereof) may use the downhole data that it receives via the signaling subsystems 114 and 115 to perform real-time analysis of the wellbore operations, determine manipulated variables, control the fluid injection systems 112, or the like. The determination of manipulated variables by the controller 111 based on measurements received from downhole tool as well as subsequent control of wellbore operations by the controller 111 is described in further detail below with respect to FIGS. 2-5.

Figure 2:
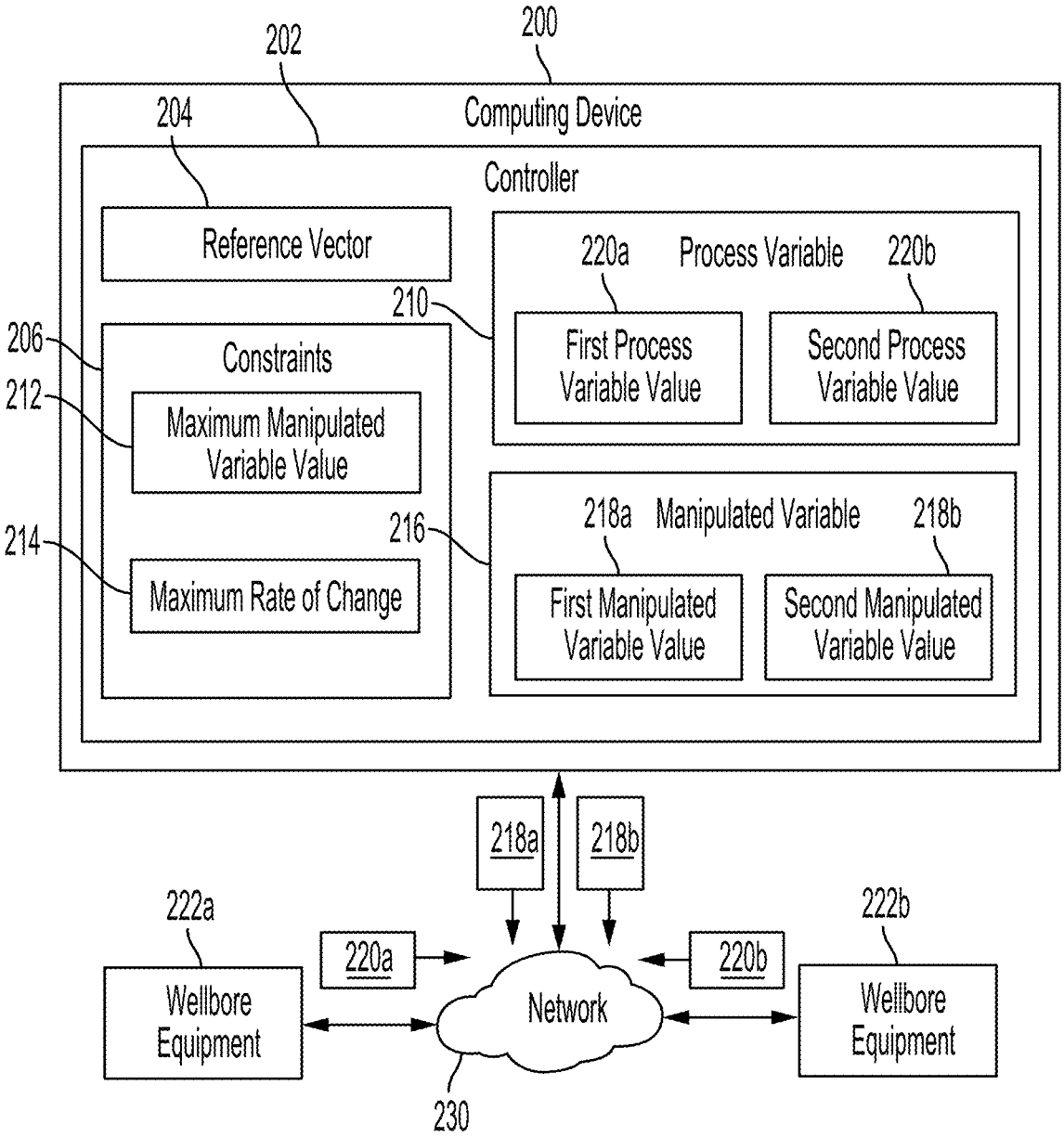
FIG. 2 is a block diagram of an example of a computing device for controlling process variables in concurrent wellbore operations, according to some embodiments of the present disclosure.

FIG. 2 is a block diagram of an example of a computing device 200 for controlling process variables for two or more wellbores in concurrent wellbore operations, according to some embodiments of the present disclosure. The computing device 200 may be part of a distributed computing environment that includes wellbore equipment 222*a-b*. The wellbore equipment may include any device associated with a wellbore operation. For example, the wellbore equipment 222*a-b* may correspond to the fluid injection systems 112, the downhole devices 116, the sensors 117, or a combination thereof shown and described above with respect to FIG. 1. Components within the distributed computing environment (e.g., the computing device 200 and the wellbore equipment 222*a-b*) may communicate using a network 230, such as the Internet or a local area network (LAN). The computing device 200 may be responsible for data processing, analysis, storage, or a combination thereof within the distributed computing environment. Examples of the computing device 200 include a server, an edge device (e.g., an IoT hub or an industrial controller), a desktop computer, a laptop computer, a virtual machine, a container, other types of computing devices, or any combination of these. In other examples, the computing device 200 may represent a serverless computing environment.

In the example of FIG. 2, the computing device 200 executes a controller 202. The controller 202 may correspond to the controller 111 of FIG. 1. The controller 202, in this example, is executing in a centralized manner. In other examples, the controller 202 may be executed in a distributed manner. An example of the controller 202 executed in a distributed manner is shown and described below with respect to FIG. 3. In either case, the controller 202 can execute a control algorithm to control more than one wellbore operation concurrently. As used herein, the terms concurrent and simultaneous may refer to two or more operations (e.g., wellbore operations) that are performed during overlapping time intervals.

To control wellbore operations concurrently, the controller 202 may receive a reference vector 204. The reference vector 204 can include a setpoint of a process variable 210 for each wellbore involved in concurrent wellbore operations. The setpoint may be a maximum value of the process variable 210 for each wellbore. As such, it may be desirable for the controller 202 to keep a value of the process variable 210 at each wellbore at or below the corresponding setpoint. As explained in further detail below, the process variable 210 may be kept at or below the setpoint at each wellbore via continuous adjustment to a manipulated variable 216.

The process variable 210 may be any dependent variable of the wellbore operation. That is, the process variable 210 may be any parameter (e.g., a performance metric or physical property) of a wellbore operation that depends on the manipulated variable 216. More specifically, the process variable 210 may depend on an instantaneous value or a trajectory of the manipulated variable 216. Examples of the process variable 210 include rate of penetration, treating pressure, wellhead pressure, bottom hole treating pressure, hydraulic horsepower used, electrical power used by one or more electric pumps, slurry density, production rate, and slurry viscosity. A process variable value (also referred to herein as a value of a process variable) may be a measurement or other quantification of a process variable. For example, for the process variable of treating pressure, a process variable value may be a pressure measurement.

In contrast, the manipulated variable 216 may be any independent variable of a wellbore operation. As such, the manipulated variable 216 may be any parameter (e.g., a physical property) of a wellbore operation that can be controlled (e.g., adjusted) from a surface of the wellbore. Examples of the manipulated variable 216 include slurry rate, proppant concentration, liquid additive concentration, valve positioning, and the like. A manipulated variable value (also referred to herein as a value of a manipulated variable) may be a measurement or other quantification of a manipulated variable. For example, for the manipulated variable of slurry rate, a manipulated variable value may be a value of the slurry rate expressed in gallons per minute.

In the example of FIG. 2, there may be a first wellbore operation and a second wellbore operation occurring concurrently (e.g., during overlapping time intervals) at a first wellbore and a second wellbore respectively (e.g., at the first wellbore 102 and the second wellbore 103 respectively). In one example, as described above with respect to FIG. 1, the first and second wellbore operations may be fracturing operations. In another example, the first wellbore operation may be a drilling operation occurring with respect to the first wellbore while a casing operation (e.g., an operation in which casing is run into a wellbore) is performed at the second wellbore. Although the examples herein are described with respect two concurrent wellbore operations, the controller may control any number of concurrent wellbore operations (e.g., 4 concurrent wellbore operations, 6 concurrent wellbore operations, etc.) at any number of wellbores (e.g., 4 wellbores, 6 wellbores, etc.).

First wellbore equipment 222*a* shown in FIG. 2 may be positioned at a surface of the first wellbore, downhole in the first wellbore, or a combination thereof during the first wellbore operation. Similarly, second wellbore equipment 222*b* may be positioned at a surface of the second wellbore, downhole in the second wellbore, or a combination thereof during the second wellbore operation. The wellbore equipment 222*a-b* may be controlled by the controller 202 to implement certain values of the manipulated variable 216. For example, the wellbore equipment 222*a-b* may include pump groups that are controlled by the controller 202 to implement certain slurry rates. Due to the process variable 210 being dependent on the manipulated variable 216, the controller 202 may affect the values of the process variable 210 the wellbores by controlling the wellbore equipment 222*a-b* to implement the certain values of the manipulated variable 216.

For example, to control the first wellbore operation, the controller 202 may determine a first manipulated variable value 218*a* based the reference vector 204 (e.g., based on the setpoint of the process variable for the first wellbore). To do so, the controller 202 may determine a relationship between the manipulated variable 216 and the process variable 210. The controller 202 may determine the relationship based on historical data that includes manipulated variable values and corresponding process variable values. As a result, the controller 202 may determine the first manipulated variable value 218*a* that, when implemented at the first wellbore, causes a first process variable value 220*a* of the process variable 210 to be equal to or less than the setpoint in the reference vector 204. The controller 202 may similarly determine a second manipulated variable value 218*b* based on the reference vector 204 (e.g., based on the setpoint of the process variable 210 for the second wellbore). In some examples, the setpoint of the process variable of the first and second wellbores may be the same value. In other examples, the setpoint of the process variable of the first and second wellbores may be different values.

Additionally, in some examples, the controller 202 may determine the first manipulated variable value 218*a* and the second manipulated variable value 218*b* based on constraints 206. That is, the controller 202 may further determine the manipulated variable values 218*a-b* such that the manipulated variable values 218*a-b* satisfy one or more constraints 206. The controller 202 may determine manipulated variable values 218*a-b* that satisfy the constraints 206 in addition to determining the manipulated variable values 218*a-b* that result in process variable values that are at or below the setpoints.

The controller 202 may receive and store the constraints 206 for use in determining the manipulated variable values 128*a-b* that satisfy the constraints 206. In an example, the constraints 206 include a maximum manipulated variable value 212. One of the constraints 206 may therefore indicate that the manipulated variable values determined by the controller 202 must be equal to or less than the maximum manipulated variable. Additionally or alternatively, the constraints may include a minimum manipulated variable value and one of the constraints 206 may indicate that the manipulated variable values are to be equal to or greater than the minimum manipulated variable value.

Moreover, in another example, one of the constraints 206 may indicate that the manipulated variable values for each of the wellbore operations are to be substantially equal. Alternatively, one of the constraints 206 may indicate that the first manipulated variable value is to be less than the second manipulated variable value or vice versa. The constraints 206 may also include a maximum rate of change 214 for the manipulated variable, for the process variable, or for both the process variable and the manipulated variable. One of the constraints 206 may therefore indicate that a difference between a previous manipulated variable and a new manipulated variable is to be equal to or less than the maximum rate of change 214. In another example, one of the constraints 206 may indicate that a difference in a process variable value caused by an adjustment to a manipulated variable value is to be equal to or less than the maximum rate of change 214. Other constraints may be imposed on the manipulated variable 216 in other examples.

After initial manipulated variable values (e.g., the first manipulated variable value 218*a* and the second manipulated variable value 218*b*) are determined by the controller 202, the controller 202 can control the wellbore operations to implement the manipulated variable values. The controller 202 may control the wellbore operations by controlling the wellbore equipment 222*a-b* to implement the manipulated variable values 218*a-b*. For example, the controller 202 may control the pump groups to implement slurry rates. As a result, the controller 202 can affect the process variable 210. For example, the implementation of the slurry rates can affect treating pressure in concurrent fracturing operations.

After implementing the manipulated variable values 218*a-b* of the manipulated variable 216, the controller 202 may receive process variable values 220*a-b* of the process variable 220. In an example, some of the wellbore equipment 222*a-b* may be measurement devices (e.g., pressure measurement devices, temperature measurement devices, flow measurement devices, fluid composition and density measurement devices, etc.). The measurement devices can obtain measurements (e.g., the process variable values 220*a-b*) of the process variable 210 (e.g., of treating pressure) and transmit the measurements to the controller 202.

The controller 202 may then adjust the manipulated variable values 218*a-b* of the manipulated variable 216 (e.g., by determining new manipulated variable values) based on the process variable values 220*a-b*. For example, the controller 202 may determine new manipulated variable values that are lower than the manipulated variable values 218*a-b* if one or more of the process variable values 210*a-b* exceed a corresponding setpoint in the reference vector 204. The adjustments to the manipulated variable values 218*a-b* may further be based on the constraints 206 described above.

In some examples, the controller 202 may be a closed-loop feedback controller. A closed-loop feedback controller may use feedback (e.g., the process variable values obtained from the measurement devices) to control states or outputs of a dynamical system (e.g., to adjust the manipulated variable values). Examples of system architectures in which the controller is a closed-loop feedback controller are shown and described in further detail below with respect to FIGS. 4-5.

Alternatively, in other examples, the controller 202 may be a model-predictive controller. In examples in which the controller 202 is a model-predictive controller, the controller 202 may use a model of concurrent wellbore operations to predict outcomes (e.g., behaviors) of the concurrent wellbore operations. For example, the model may predict a drilling trajectory for concurrent drilling operations or a hydrocarbon production increase for concurrent fracturing operations. The model may further predict values of manipulated variables, values of process variables, or the like. The model may further show relationships between the predicted values and the predicted outcomes. The model may include each of the wellbores included in the concurrent wellbore operations and the wellbore equipment 222*a-b* associated with each of the wellbores. The predicted values, the predicted outcomes, the relationships therebetween, or other information provided by the model may then be used to determine values of manipulated variables and control the concurrent wellbore operations.

Although FIG. 2 shows values being determined by the controller 202 for a singular manipulated variable 216, values of different manipulated variables may be determined for different wellbores in other examples. For example, the manipulated variable for the first wellbore operation may be a slurry rate, while the manipulated variable for the second wellbore operation may be proppant concentration. In this case, the controller 202 may determine a value for each manipulated variable based on a relationship between the manipulated value and a process variable 210 (e.g., a relationship between slurry rate and the process variable 210 and a relationship between proppant concentration and the process variable 210). The controller 202 may further determine values for each manipulated variables based on the reference vector 204 for the process variable 210 and constraints imposed on the manipulated variable, the process variable, or the combination thereof.

In some examples, to simplify calculations, the controller 202 may covert each manipulated variable value to a unitless number and use the unitless number when determining and adjusting each manipulated variable value. In such examples, each manipulated variable value may be converted back to a value with units prior to using each manipulated variable value to control concurrent wellbore operations.

Alternatively, in some examples, different process variables may be of interest to the controller 202 for each of the wellbore operations. For example, a process variable for the first wellbore operation may be treating pressure, while a process variable for a second wellbore operation may be power consumption by one or more electric pumps. In this case, each manipulated variable value can be determined based on the relationship between the manipulated variable and the corresponding process variable. The manipulated variable values may further be determined based on a reference vector that includes set points for each process variable for each wellbore.

Moreover, in some examples, to simplify calculations, the controller 202 may covert each process variable value to a unitless number. The controller 202 may then select a manipulated variable value for each wellbore operation based on the unitless number for the corresponding process variable.

Figure 3:
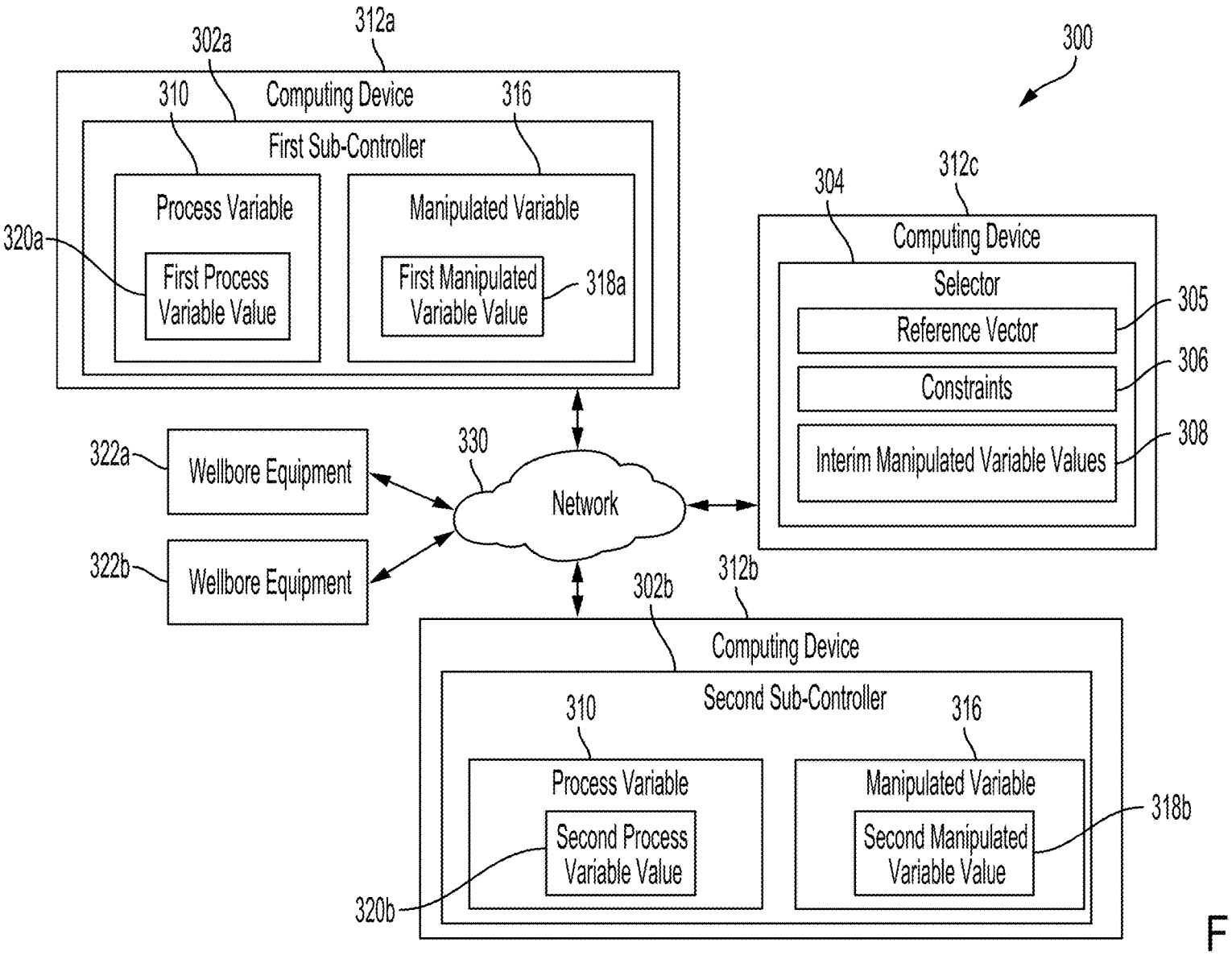
FIG. 3 is a block diagram of an example of a computing system for controlling process variables in concurrent wellbore operations, according to some embodiments of the present disclosure.

FIG. 3 is a block diagram of an example of a computing system 300 for controlling process variables for two or more wellbores in concurrent wellbore operations, according to some embodiments of the present disclosure. The computing system 300 may be part of a distributed computing environment. Components within the computing system 300 (e.g., wellbore equipment 322*a-b* and computing devices 312*a-c*) may communicate using a network 330, such as the Internet or a local area network (LAN). The wellbore equipment 322*a-b* may correspond to the fluid injection systems 112, the downhole devices 116, the sensors 117, or the combination thereof shown and described above with respect to FIG. 1. The computing devices 312*a-c* can be responsible for data processing, analysis, storage, or a combination thereof within the computing system 300. Examples of the computing devices 312*a-c* include servers, edge devices (e.g., an IoT hub or an industrial controller), desktop computers, laptop computers, virtual machines, containers, other types of computing devices, or any combination of these.

As mentioned above, in some examples, the controller 202 may be executed in a distributed manner. FIG. 3 shows an example of the controller 202 being executed in a distributed manner. That is, in FIG. 3, the controller 202 is made up of sub-controllers 302*a-b* and a selector 304. In the example shown, a first computing device 312*a* executes a first sub-controller 302*a* while a second computing device 312*b* executes a second sub-controller 302*b*. Moreover, a third computing device 312 executes the selector 304. The computing devices 312*a-c* are connected via the network 330 to enable communication among the sub-controllers 302*a-b* and the selector 304.

Additionally, the computing devices 312*a-c* are connected to the wellbore equipment 322*a-b* via the network 330. In an example, the first sub-controller 302*a* communicates with and controls at least some of the first wellbore equipment 322*a*. Moreover, in the example, the second sub-controller 302*b* communicates with and controls at least some of the second wellbore equipment 322*b*. The first wellbore equipment 322*a* may be positioned at a surface of a first wellbore, downhole in the first wellbore, or a combination thereof. The first wellbore equipment 322*a* may further be used in a first wellbore operation performed at the first wellbore. Additionally, the second wellbore equipment 322*b* may be positioned a surface of a second wellbore, downhole in the second wellbore, or a combination thereof. The second wellbore equipment 322*b* may be used in a second wellbore operation performed at the second wellbore. The first and second wellbore operations may be performed concurrently. The sub-controllers 302*a-b* and the selector 304 may control the concurrent wellbore operations.

To do so, the first sub-controller 302*a* may determine a first interim manipulated variable value of a manipulated variable 316 for the first wellbore operation. The second sub-controller 302*b* may determine a second interim manipulated variable value for the second wellbore operation. The sub-controllers 302*a-b* may determine the interim manipulated variable values 308 based on a relationship between the manipulated variable 316 and a process variable 310. For example, each of the sub-controllers 302*a-b* may select interim manipulated variables that are expected to affect the process variable in a desired manner. For example, the sub-controllers 302*a-b* may determine the interim manipulated variable values 308 that, when implemented at the wellbore operations, are expected to cause process variable values of the process variable 310 to be equal to or less than setpoints in a reference vector 305.

The process variable 310 may be a parameter of the first and second wellbore operations that depends on the manipulated variable. For example, the first and second wellbore operation may be simultaneous fracturing operations, the process variable 310 may be treating pressure, and the manipulated variable 316 may be proppant concentration.

The sub-controllers 302*a-b* may then transmit the interim manipulated variable values 308 to the selector 304. The selector 304 may determine manipulated variable values 318*a-b* for each of the wellbore operations from the interim manipulated variable values 308. The selector 304 may use constraints 306 to determine the manipulated variable values 318*a-b* from the interim manipulated variable values 308. Additionally, a set of predetermined rules may determine how the selector 304 selects the manipulated variable values using the constraint 306.

For example, one of the constraints 306 may indicate that each of the manipulated variable values for the manipulated variable 316 are to be substantially equal. In some examples, the term "substantially equal" may mean that each of the values are to be within 5% or within 10% of one another. Based on a predefined rule, the selector 304 may select a smallest of the interim manipulated variable values to be the manipulated variable values 318*a-b*. In another example, based on another predefined rule, the selector 304 may select the interim manipulated variable value that produces a smallest rate of change for the manipulated variable. In other words, the interim manipulated variable value that is closest to a current manipulated variable value implemented by the wellbore equipment 322*a-b* can be selected by the selector 304.

After the selector 304 selects the manipulated variable values 318*a-b* from the interim manipulated variable values 308, the selector 304 may transmit the manipulated variable values 318*a-b* to the sub-controllers 302*a-b*. The sub-controllers 302*a-b* may then control the wellbore equipment 322*a-b* based on the manipulated variable values 318*a-b*.

Although the example shown in FIG. 3, shows each computing device 312*a-b* executing one of the sub-controllers 302*a-b* and the selector 304. In other examples, computing devices may execute more than one sub-controller or may execute one or more sub-controllers and a selector. Additionally, there may be a different number of computing devices, which may execute a different number of sub-controllers in other examples.

Moreover, in other examples, a selector may select one of the process variable values (e.g., first process variable value 320*a* or second process variable value 330*b*). Then, a singular controller (e.g., a PID controller) may take the reference vector 305 and the selected process variable value as inputs and, in response, produce an output (e.g., a manipulated variable value). The output from the controller may then be implemented via one or more wellbore devices at one or more wellbores.

Figure 4:
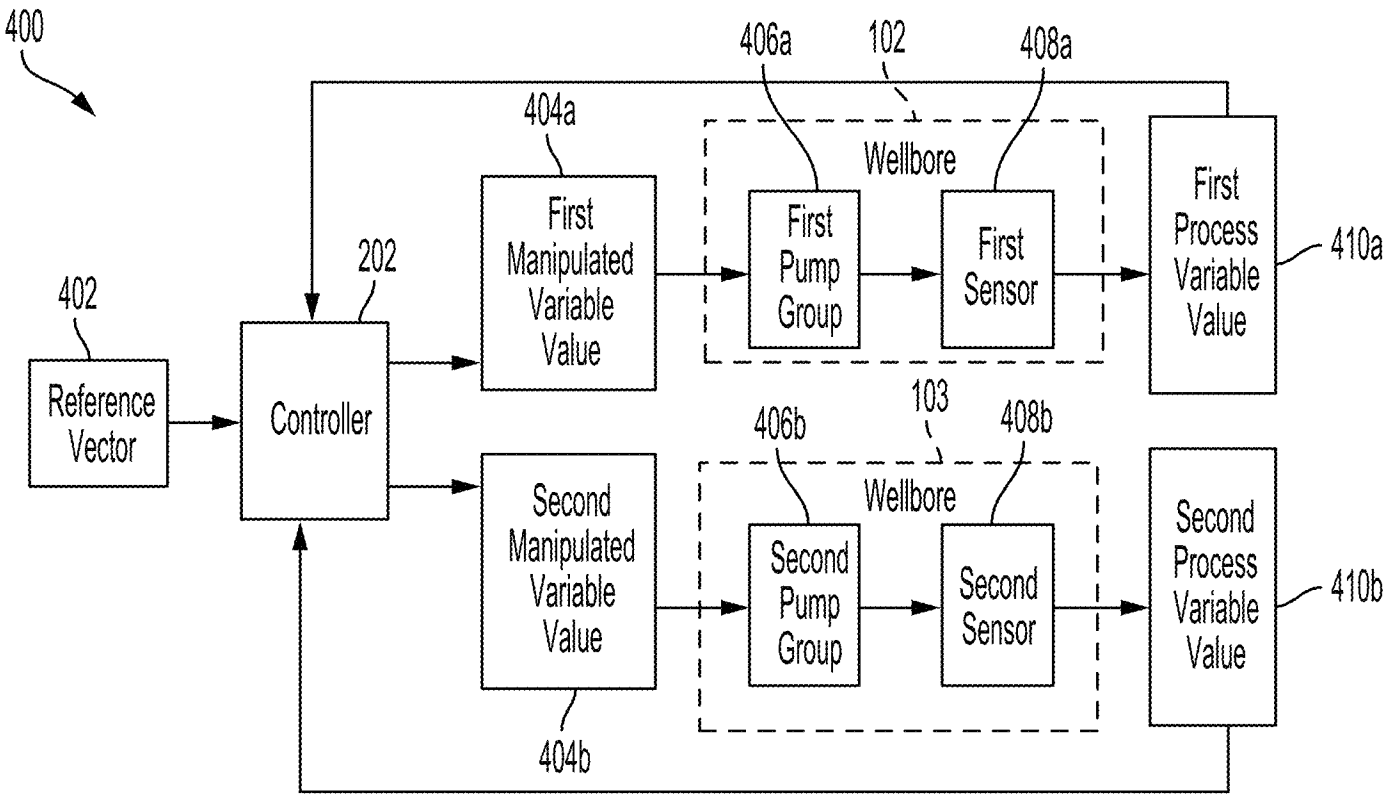
FIG. 4 is a block diagram of an example of a system architecture for controlling process variables in concurrent wellbore operations, according to some embodiments of the present disclosure.

FIG. 4 is a block diagram of an example of a system architecture 400 for controlling process variables for two or more wellbores in concurrent wellbore operations, according to some embodiments of the present disclosure. In FIG. 4, the controller 202 is a closed-loop feedback controller. Therefore, as shown, the controller 202 may receive process variable values 410*a-b* from the first wellbore 102 and the second wellbore 103 respectively. The process variable values 410*a-b* may be measurements obtained via wellbore equipment associated with each of the wellbores (e.g., sensors 408*a-b*). The measurements may be obtained during concurrent wellbore operations (e.g., during simultaneous fracturing operations). The controller 202 may receive the measurements periodically (e.g., every second, every 30 seconds, every 60 seconds, etc.) during the wellbore operations.

Additionally, the controller 202 may generate manipulated variable values 404*a-b*. The controller 202 may generate the manipulated variable values 404*a-b* based on feedback received from the sensors 408*a-b* (e.g., the process variable values 410*a-b*). The controller 202 may further continuously generate and adjust manipulated variable values throughout the wellbore operations based on the feedback (e.g., based on the measurements obtained from the wellbore operations). The controller 202 may further generate and adjust the manipulated variable values based on a reference vector 402 that includes setpoints for each of the wellbores 102 and 102. The setpoints may be a maximum value for a process variable, of which the process variable values 410*a-b* are quantification. Accordingly, the controller 202 may adjust the manipulated variable values such that the process variable values 410*a-b* are equal to or less than the setpoints.

In an example, fracturing operations are performed concurrently at the first and second wellbores 102, 103 respectively. The controller 202 may control the fracturing operations by controlling pump groups 406*a-b* or other wellbore equipment at each of the wellbores 102, 103. For example, a manipulated variable, of which the manipulated variable values 404*a-b* are quantifications, may be a slurry rate. A process variable, of which the process variable values 410*a-b* are quantifications, may be treating pressure. As the controller 202 generates the manipulated variable values 404*a-b*, the controller 202 can transmit signals indicative of the manipulated variable values 404*a-b* to the pump groups 406*a-b*. In this way, the controller 202 can cause the pump groups 406*a-b* to implement or maintain a certain slurry rate. Additionally, the treating pressure may be dependent on slurry rate. As such, changes to the slurry rates can cause changes to treating pressures in the wellbore operations. Therefore, by controlling the slurry rate via the pump groups 406*a-b*, the controller 202 can also affect (e.g., control) the treating pressure.

Figure 5:
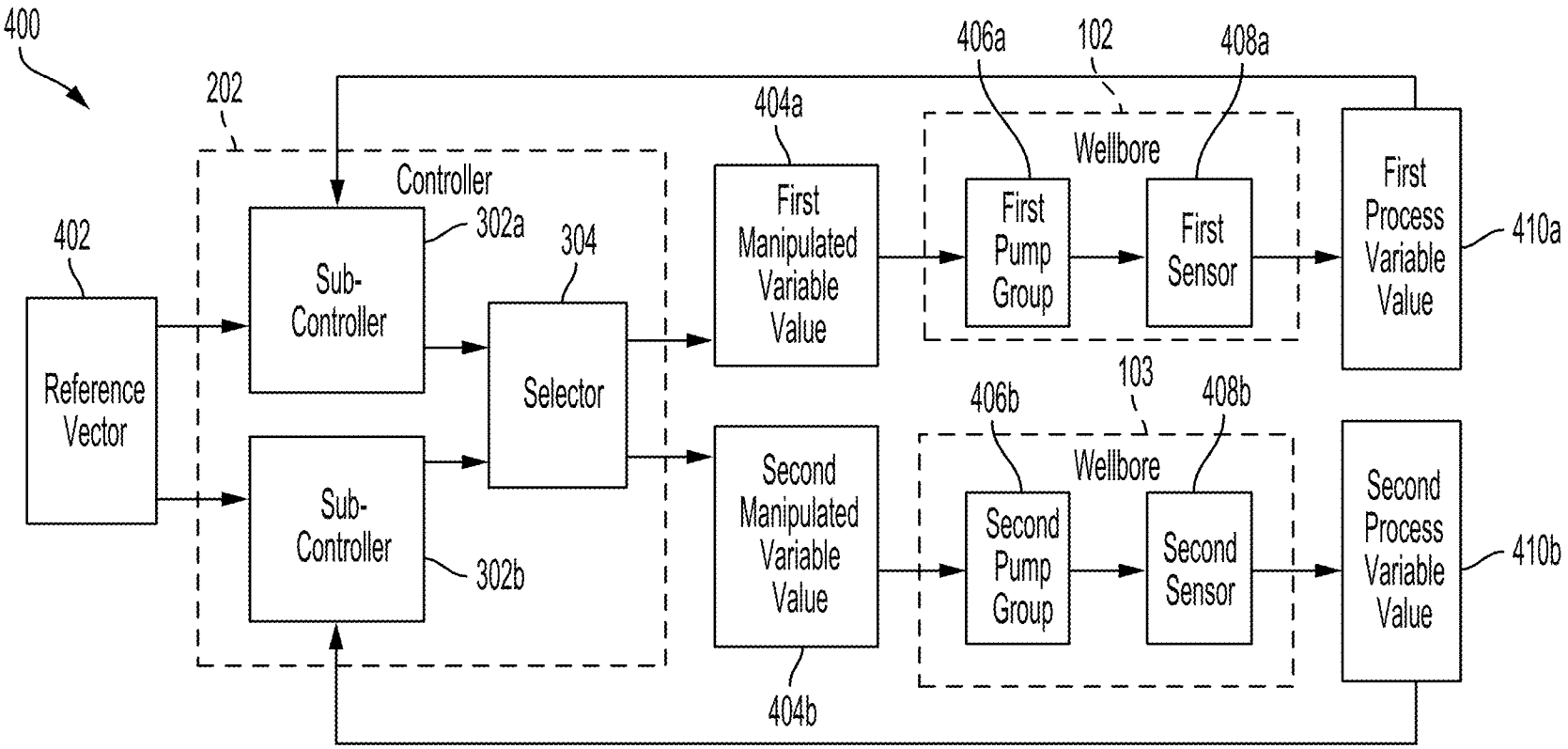
FIG. 5 is a block diagram of another example of a system architecture for controlling process variables in concurrent wellbore operations, according to some embodiments of the present disclosure.

Turning now to FIG. 5, FIG. 5 shows the example in which the controller 202 is provided in distributed manner. Thus, in FIG. 5, the controller 202 includes the sub-controllers 302*a-b* and the selector 304. As shown, the sub-controllers 302*a-b* can receive the process variable values 410*a-b*. The sub-controllers 302*a-b* may then generate interim manipulated variable values based on the process variable values 410*a-b* and transmit the interim manipulated variable values to the selector 304. The selector 304 may select the manipulated variable values 404*a-b* from the interim manipulated variable values. For example, the selector 304 may select one of the interim manipulated variable values and set the manipulated variable values 404*a-b* equal to the selected one of the interim manipulated variable values.

Figure 6:
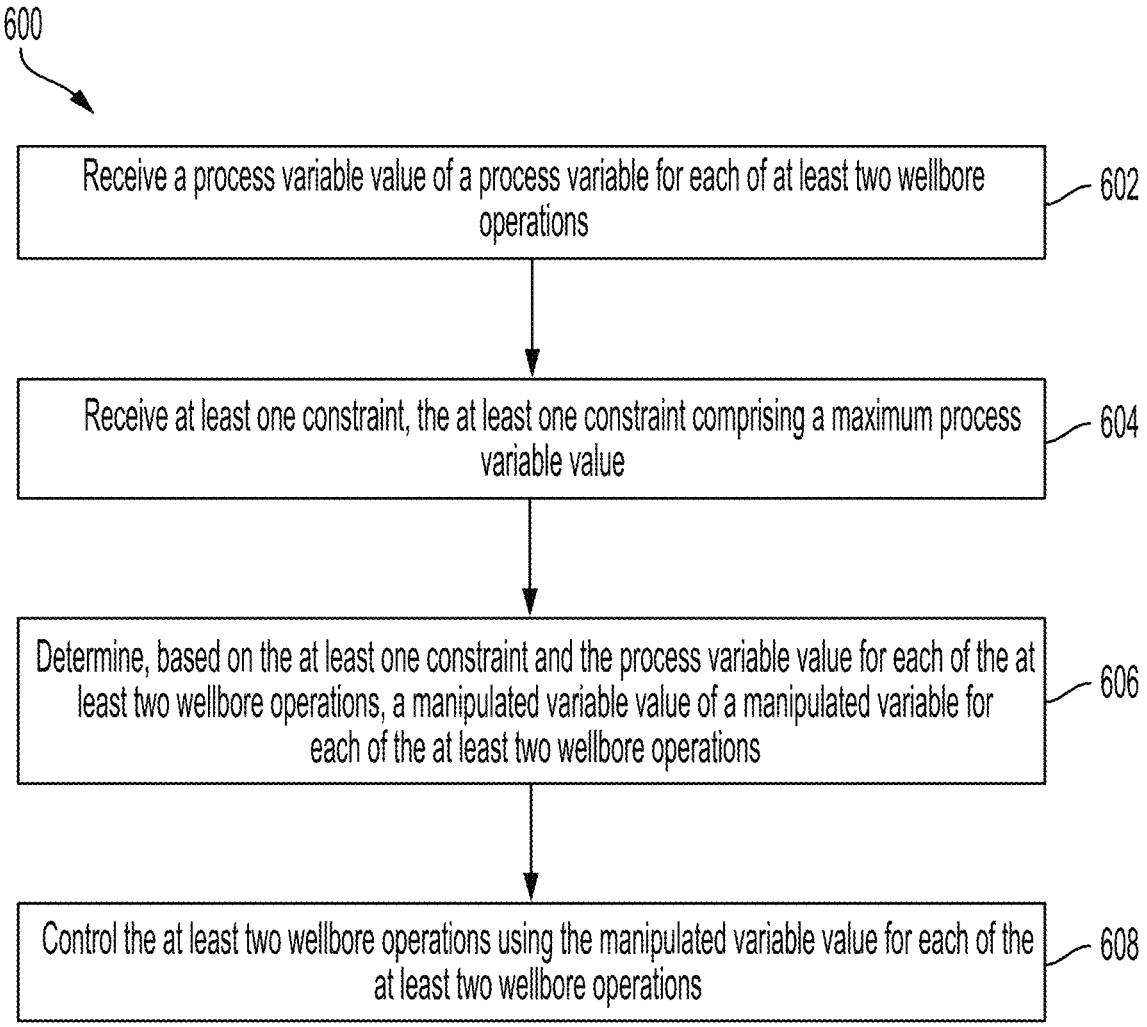
FIG. 6 is a flowchart of an example of a method for controlling process variables in concurrent wellbore operations, according to some embodiments of the present disclosure.

FIG. 6 is a flowchart of an example of a method 600 for controlling process variables for two or more wellbores in concurrent wellbore operations, according to some embodiments of the present disclosure. In some examples, the processing device 702 shown and described below with respect to FIG. 7 can perform one or more of the steps shown in FIG. 6. For example, the processing device 702 may execute the controller 111 of FIG. 1 or the controller 202 of FIGS. 2-5 to perform one or more of the steps shown in FIG. 6. In other examples, the processing device 702 can implement more steps, fewer steps, different steps, or a different order of the steps depicted in FIG. 6. The steps of FIG. 6 are described below with reference to components discussed above in FIGS. 1-5.

At block 602, the method 600 involves receiving, by a controller, a process variable value of a process variable for each of at least two wellbore operations. The wellbore operations may be concurrent wellbore operations (e.g., separate wellbore operations that are performed during overlapping time intervals). In an example, the controller 202 may receive the first process variable value 220*a* and the second process variable value 220*b* of the process variable 210. The process variable 210 may be a parameter of each of the wellbore operations that is dependent on a manipulated variable 216 of each of the wellbore operations. Additionally, the manipulated variable 216 may be a parameter of the wellbore operation that can be controlled from a surface of the wellbore (e.g., by the controller transmitting a signal to a piece of wellbore equipment during a wellbore operation). In contrast, the process variable 210 may not be controllable directly from the surface of the wellbore. Instead, the process variable 210 may be indirectly controlled as result of the control of the manipulated variable 21.

The process variable values 220*a-b* may be a measurement or other quantification of the process variable 210 for each wellbore operation. In the example, the process variable 210 is a treating pressure for each of the wellbore operations and the manipulated variable 216 is slurry rate for each of the wellbore operations. Thus, the process variable values 220*a-b* may be measurements of treatment pressure received by the controller 202 from pressure sensors or other devices associated with each of the wellbore operations. Additionally, in the example, the treating pressure and the slurry rate may have a directly proportional relationship.

At block 604, the method 600 involves receiving, by the controller, at least one constraint, the at least one constraint comprising a maximum process variable value. In the example, the controller 202 may receive a reference vector 204 with a setpoint for process variable 210 for each of the wellbore operations. The setpoint may be the maximum process variable value. That is, in the example in which the process variable 210 is the treating pressure, the setpoint for each of the wellbore operations may be a highest treating pressure that can be safely applied during each of the wellbore operations. The constraint may therefore be a constraint on the process variable that includes the setpoint and indicates that the process variable values 220*a-b* for each of the wellbore operations are to be equal to or less than the setpoint. This constraint can facilitate stability for the wellbores at which the wellbore operations are performed.

In some examples, there may further be one or more constraints on the manipulated variable. For example, a constraint on the manipulated variable may indicate that the manipulated variable value for each of the at least two wellbore operations are to be substantially equal. A manipulated variable value may be a quantification of the manipulated variable. For example, the manipulated variable value may be a value of the slurry rate as implemented by a pump group during a wellbore operation. In another example, a constraint on the manipulated variable may indicate that the manipulated variable value for each of the wellbore operations are to be less than or equal to a maximum manipulated variable value. This constraint may be related to the maximum process variable value. This constraint may further help to prevent damage to the wellbore equipment that implements the manipulated variable (e.g., the pump groups). Moreover, another constraint on the manipulated variable may include a maximum rate of change for the manipulated variable. This constraint may also help to prevent damage to the wellbore equipment that implements the manipulated variable.

At block 606, the method 600 involves determining, by the controller and based on the at least one constraint and the process variable value for each of the at least two wellbore operations, manipulated variable values of the manipulated variable for each of the at least two wellbore operations. That is, the manipulated variable may be determined by the controller such that the manipulated variable values satisfy the constraints. For example, each of the manipulated variable values may be equal to one another and less than the maximum manipulated variable value. Additionally, to select manipulated variable values based on the process variable values, the controller may compare the process variable values to the set point in the reference vector. The controller may further compare the process variable values to historical data indicative of desirable process variable values (e.g., desirable pressures measurements). The controller 202 may then determine the manipulated variable values expected to provide the desirable process variable values. For example, if the process variable values 220*a-b* are relatively low in comparison to historical data of process variable values, the controller 202 may determine manipulated variable values that are greater than previous manipulated variables values. The previous manipulated variable values may be the manipulated variable values used in the wellbore operations when the process variable values 220*a-b* were measured.

At block 608, the method 600 involves controlling, by the controller, the at least two wellbore operations using the manipulated variable value for each of the at least two wellbore operations. In the example, the manipulated variable values determined by the controller are slurry rate values. Thus, to control the wellbore operations, the controller may transmit a signal to pump groups associated with each of the wellbore operations to cause the pump groups to implement the manipulated variable values. In other words, the transmission of the signal from the controller may cause the pump group associated with each wellbore operation to adjust a slurry rate (e.g., a rate at which the pump group is pumping a slurry into the wellbore during the wellbore operation) from the previous slurry rate values to the slurry rate value determined by the controller at block 608.

Figure 7:
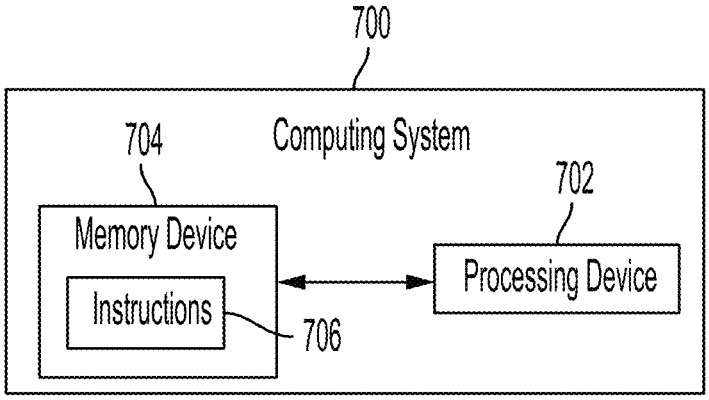
FIG. 7 is a block diagram of a computing environment, according to some embodiments of the present disclosure.

FIG. 7 is a block diagram of a computing system 700, according to one example of the present disclosure. The computing system 700 can correspond to the controller 111 of FIG. 1, the computing device 200 of FIG. 2, or the computing system 300 of FIG. 3. The computing system 700 can include a processing device 702 communicatively coupled to a memory device 704.

The processing device 702 can include one processing device or multiple processing devices. The processing device 702 can be referred to as a processor. Non-limiting examples of the processing device 702 include a Field-Programmable Gate Array (FPGA), an application-specific integrated circuit (ASIC), and a microprocessor. The processing device 702 can execute instructions 706 stored in the memory device 704 to perform operations. In some examples, the instructions 706 can include processor-specific instructions generated by a compiler or an interpreter from code written in any suitable computer-programming language, such as C, C++, C#, Java, Python, or any combination of these.

The memory device 704 can include one memory device or multiple memory devices. The memory device 704 can be non-volatile and may include any type of memory device that retains stored information when powered off. Non-limiting examples of the memory device 704 include electrically erasable and programmable read-only memory (EEPROM), flash memory, or any other type of non-volatile memory. At least some of the memory device 704 includes a non-transitory computer-readable medium from which the processing device 702 can read instructions 706. A computer-readable medium can include electronic, optical, magnetic, or other storage devices capable of providing the processing device 702 with the instructions 706 or other program code executable to perform operations. Non-limiting examples of a computer-readable medium include magnetic disk(s), memory chip(s), ROM, random-access memory (RAM), an ASIC, a configured processor, and optical storage.

In some examples, the processing device 702 can execute the instructions 706 to perform operations. For example, the processing device 702 can execute the controller 111 of FIG. 1 or the controller 202 of FIGS. 2-5 to perform any of the operations described above with respect to FIGS. 1-6.

In some aspects, systems and methods for controlling process variables for two or more wellbores in concurrent wellbore operations are provided according to one or more of the following examples:

As used below, any reference to a series of examples is to be understood as a reference to each of those examples disjunctively (e.g., "Claim(s) 1-4" is to be understood as "Claims 1, 2, 3, or 4").

Example 1 is a system comprising: a processor; and a memory device that includes instructions executable by the processor for causing the processor to perform operations comprising: receiving, by a controller, a process variable value of a process variable for each of at least two wellbore operations, a first wellbore operation of the at least two wellbore operations being associated with a first wellbore and a second wellbore operation of the at least two wellbore operations being associated with a second wellbore, and the process variable being a parameter of each of the at least two wellbore operations that is dependent on a manipulated variable of each of the at least two wellbore operations; receiving, by the controller, at least one constraint, the at least one constraint comprising a maximum process variable value; determining, by the controller and based on the maximum process variable value and the process variable value for each of the at least two wellbore operations, a manipulated variable value of the manipulated variable for each of the at least two wellbore operations; and controlling, by the controller, the at least two wellbore operations using the manipulated variable value for each of the at least two wellbore operations.

Example 2 is the system of claim 1, wherein the process variable is a treating pressure and wherein the manipulated variable is a slurry rate.

Example 3 is the system of claim(s) 1-2, wherein the at least one constraint further comprises a constraint on the manipulated variable, the constraint on the manipulated variable indicating that the manipulated variable value for each of the at least two wellbore operations are to be substantially equal.

Example 4 is the system of claim(s) 1-3, wherein the at least one constraint further comprises a constraint on the manipulated variable, the constraint on the manipulated variable indicating that the manipulated variable value for each of the at least two wellbore operations are to be less than or equal to a maximum manipulated variable value.

Example 5 is the system of claim(s) 1-4, wherein the controller comprises at least a first sub-controller, a second sub-controller, and a selector, and wherein: the first sub-controller determines a first interim manipulated variable value for the first wellbore operation of the at least two wellbore operations; the second sub-controller determines a second interim manipulated variable value for the second wellbore operation of the at least two wellbore operations; and the selector determines the manipulated variable value for each of the at least two wellbore operations based on the first interim manipulated variable value and the second interim manipulated variable value.

Example 6 is the system of claim(s) 1-5, wherein the manipulated variable value for each of the at least two wellbore operations comprises a first manipulated variable value and a second manipulated variable value, and wherein the at least one constraint further comprises a constraint that indicates that the first manipulated variable value is to be less than the second manipulated variable value.

Example 7 is the system of claim(s) 1-6, wherein controlling the at least two wellbore operations using the manipulated variable value for each of the at least two wellbore operations causes the process variable value of the process variable for each of the at least two wellbore operations to be equal to or less than the maximum process variable value.

Example 8 is the system of claim(s) 1-7, wherein the at least one constraint further comprises a maximum rate of change of the manipulated variable.

Example 9 is a computer-implemented method comprising: receiving, by a controller, a process variable value of a process variable for each of at least two wellbore operations, a first wellbore operation of the at least two wellbore operations being associated with a first wellbore and a second wellbore operation of the at least two wellbore operations being associated with a second wellbore, and the process variable being a parameter of each of the at least two wellbore operations that is dependent on a manipulated variable of each of the at least two wellbore operations; receiving, by the controller, at least one constraint, the at least one constraint comprising a maximum process variable value; determining, by the controller and based on the maximum process variable value and the process variable value for each of the at least two wellbore operations, a manipulated variable value of the manipulated variable for each of the at least two wellbore operations; and controlling, by the controller, the at least two wellbore operations using the manipulated variable value for each of the at least two wellbore operations.

Example 10 is the computer-implemented method of claim 9, wherein the process variable is a treating pressure and wherein the manipulated variable is a slurry rate.

Example 11 is the computer-implemented method of claim(s) 9-10, wherein the at least one constraint further comprises a constraint on the manipulated variable, the constraint on the manipulated variable indicating that the manipulated variable value for each of the at least two wellbore operations are to be substantially equal.

Example 12 is the computer-implemented method of claim(s) 9-11, wherein the at least one constraint further comprises a constraint on the manipulated variable, the constraint on the manipulated variable indicating that the manipulated variable value for each of the at least two wellbore operations are to be less than or equal to a maximum manipulated variable value.

Example 13 is the computer-implemented method of claim(s) 9-12, wherein the controller comprises at least a first sub-controller, a second sub-controller, and a selector, and wherein: the first sub-controller determines a first interim manipulated variable value for the first wellbore operation of the at least two wellbore operations; the second sub-controller determines a second interim manipulated variable value for the second wellbore operation of the at least two wellbore operations; and the selector determines the manipulated variable value for each of the at least two wellbore operations based on the first interim manipulated variable value and the second interim manipulated variable value.

Example 14 is the computer-implemented method of claim(s) 9-13, wherein the manipulated variable value for each of the at least two wellbore operations comprises a first manipulated variable value and a second manipulated variable value, and wherein the at least one constraint further comprises a constraint that indicates that the first manipulated variable value is to be less than the second manipulated variable value.

Example 15 is the computer-implemented method of claim(s) 9-14, wherein controlling the at least two wellbore operations using the manipulated variable value for each of the at least two wellbore operations causes the process variable value of the process variable for each of the at least two wellbore operations to be equal to or less than the maximum process variable value.

Example 16 is a non-transitory computer-readable medium comprising instructions that are executable by a processing device for causing the processing device to perform operations comprising: receiving, by a controller, a process variable value of a process variable for each of at least two wellbore operations, a first wellbore operation of the at least two wellbore operations being associated with a first wellbore and a second wellbore operation of the at least two wellbore operations being associated with a second wellbore, and the process variable being a parameter of each of the at least two wellbore operations that is dependent on a manipulated variable of each of the at least two wellbore operations; receiving, by the controller, at least one constraint, the at least one constraint comprising a maximum process variable value; determining, by the controller and based on the maximum process variable value and the process variable value for each of the at least two wellbore operations, a manipulated variable value of the manipulated variable for each of the at least two wellbore operations; and controlling, by the controller, the at least two wellbore operations using the manipulated variable value for each of the at least two wellbore operations.

Example 17 is the non-transitory computer-readable medium of claim 16, wherein the process variable is a treating pressure and wherein the manipulated variable is a slurry rate.

Example 18 is the non-transitory computer-readable medium of claim(s) 16-17, wherein the at least one constraint further comprises a constraint on the manipulated variable, the constraint on the manipulated variable indicating that the manipulated variable value for each of the at least two wellbore operations are to be substantially equal.

Example 19 is the non-transitory computer-readable medium of claim(s) 16-18, wherein the at least one constraint further comprises a constraint on the manipulated variable, the constraint on the manipulated variable indicating that the manipulated variable value for each of the at least two wellbore operations are to be less than or equal to a maximum manipulated variable value.

Example 20 is the non-transitory computer-readable medium of claim(s) 16-19, wherein the controller comprises at least a first sub-controller, a second sub-controller, and a selector, and wherein the first sub-controller determines a first interim manipulated variable value for the first wellbore operation of the at least two wellbore operations; the second sub-controller determines a second interim manipulated variable value for the second wellbore operation of the at least two wellbore operations; and the selector determines the manipulated variable value for each of the at least two wellbore operations based on the first interim manipulated variable value and the second interim manipulated variable value.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A computer-implemented method comprising:

receiving, by a controller comprising at least a first sub-controller, a second sub-controller, and a selector, a process variable value of a process variable for each of at least two wellbore operations, a first wellbore operation of the at least two wellbore operations being associated with a first wellbore and a second wellbore operation of the at least two wellbore operations being associated with a second wellbore, and the process variable being a parameter of each of the at least two wellbore operations that is dependent on a manipulated variable of each of the at least two wellbore operations;

receiving, by the controller, at least one constraint, the at least one constraint comprising a maximum process variable value;

determining, by the controller and based on the maximum process variable value and the process variable value for each of the at least two wellbore operations, a manipulated variable value of the manipulated variable for each of the at least two wellbore operations wherein determining the manipulated variable value of the manipulated variable for each of the at least two wellbore operations comprises:

the first sub-controller determining a first interim manipulated variable value for the first wellbore operation of the at least two wellbore operations;

the second sub-controller determining a second interim manipulated variable value for the second wellbore operation of the at least two wellbore operations; and the selector determining the manipulated variable value for each of the at least two wellbore operations based on the first interim manipulated variable value and the second interim manipulated variable value; and controlling, by the controller, the at least two wellbore operations using the manipulated variable value for each of the at least two wellbore operations.

2. The computer-implemented method of claim 1, wherein the process variable is a treating pressure and wherein the manipulated variable is a slurry rate.

3. The computer-implemented method of claim 1, wherein the at least one constraint further comprises a constraint on the manipulated variable, the constraint on the manipulated variable indicating that the manipulated variable value for each of the at least two wellbore operations are to be substantially equal.

4. The computer-implemented method of claim 1, wherein the at least one constraint further comprises a constraint on the manipulated variable, the constraint on the manipulated variable indicating that the manipulated variable value for each of the at least two wellbore operations are to be less than or equal to a maximum manipulated variable value.

5. The computer-implemented method of claim 1, wherein the manipulated variable value for each of the at least two wellbore operations comprises a first manipulated variable value and a second manipulated variable value, and wherein the at least one constraint further comprises a constraint that indicates that the first manipulated variable value is to be less than the second manipulated variable value.

6. The computer-implemented method of claim 1, wherein controlling the at least two wellbore operations using the manipulated variable value for each of the at least two wellbore operations causes the process variable value of the process variable for each of the at least two wellbore operations to be equal to or less than the maximum process variable value.

7. A system comprising:

a processor; and a memory device that includes instructions executable by the processor for causing the processor to perform operations comprising:

receiving, by a controller comprising at least a first sub-controller, a second sub-controller, and a selector, a process variable value of a process variable for each of at least two wellbore operations, a first wellbore operation of the at least two wellbore operations being associated with a first wellbore and a second wellbore operation of the at least two wellbore operations being associated with a second wellbore, and the process variable being a parameter of each of the at least two wellbore operations that is dependent on a manipulated variable of each of the at least two wellbore operations;

receiving, by the controller, at least one constraint, the at least one constraint comprising a maximum process variable value;

determining, by the controller and based on the maximum process variable value and the process variable value for each of the at least two wellbore operations, a manipulated variable value of the manipulated variable for each of the at least two wellbore operations, wherein determining the manipulated variable value of the manipulated variable for each of the at least two wellbore operations comprises:

the first sub-controller determining a first interim manipulated variable value for the first wellbore operation of the at least two wellbore operations;

the second sub-controller determining a second interim manipulated variable value for the second wellbore operation of the at least two wellbore operations; and the selector determining the manipulated variable value for each of the at least two wellbore operations based on the first interim manipulated variable value and the second interim manipulated variable value; and controlling, by the controller, the at least two wellbore operations using the manipulated variable value for each of the at least two wellbore operations.

8. The system of claim 7, wherein the process variable is a treating pressure and wherein the manipulated variable is a slurry rate.

9. The system of claim 7, wherein the at least one constraint further comprises a constraint on the manipulated variable, the constraint on the manipulated variable indicating that the manipulated variable value for each of the at least two wellbore operations are to be substantially equal.

10. The system of claim 7, wherein the at least one constraint further comprises a constraint on the manipulated variable, the constraint on the manipulated variable indicating that the manipulated variable value for each of the at least two wellbore operations are to be less than or equal to a maximum manipulated variable value.

11. The system of claim 7, wherein the manipulated variable value for each of the at least two wellbore operations comprises a first manipulated variable value and a second manipulated variable value, and wherein the at least one constraint further comprises a constraint that indicates that the first manipulated variable value is to be less than the second manipulated variable value.

12. The system of claim 7, wherein controlling the at least two wellbore operations using the manipulated variable value for each of the at least two wellbore operations causes the process variable value of the process variable for each of the at least two wellbore operations to be equal to or less than the maximum process variable value.

13. The system of claim 7, wherein the at least one constraint further comprises a maximum rate of change of the manipulated variable.

14. A non-transitory computer-readable medium comprising instructions that are executable by a processing device for causing the processing device to perform operations comprising:

receiving, by a controller comprising at least a first sub-controller, a second sub-controller, and a selector, a process variable value of a process variable for each of at least two wellbore operations, a first wellbore operation of the at least two wellbore operations being associated with a first wellbore and a second wellbore operation of the at least two wellbore operations being associated with a second wellbore, and the process variable being a parameter of each of the at least two wellbore operations that is dependent on a manipulated variable of each of the at least two wellbore operations;

receiving, by the controller, at least one constraint, the at least one constraint comprising a maximum process variable value;

determining, by the controller and based on the maximum process variable value and the process variable value for each of the at least two wellbore operations, a manipulated variable value of the manipulated variable for each of the at least two wellbore operations, wherein determining the manipulated variable value of the manipulated variable for each of the at least two wellbore operations comprises:

the first sub-controller determining a first interim manipulated variable value for the first wellbore operation of the at least two wellbore operations;

the second sub-controller determining a second interim manipulated variable value for the second wellbore operation of the at least two wellbore operations; and the selector determining the manipulated variable value for each of the at least two wellbore operations based on the first interim manipulated variable value and the second interim manipulated variable value; and controlling, by the controller, the at least two wellbore operations using the manipulated variable value for each of the at least two wellbore operations.

15. The non-transitory computer-readable medium of claim 14, wherein the process variable is a treating pressure and wherein the manipulated variable is a slurry rate.

16. The non-transitory computer-readable medium of claim 14, wherein the at least one constraint further comprises a constraint on the manipulated variable, the constraint on the manipulated variable indicating that the manipulated variable value for each of the at least two wellbore operations are to be substantially equal.

17. The non-transitory computer-readable medium of claim 14, wherein the at least one constraint further comprises a constraint on the manipulated variable, the constraint on the manipulated variable indicating that the manipulated variable value for each of the at least two wellbore operations are to be less than or equal to a maximum manipulated variable value.

* * * * *